US005412836A

United States Patent [19]

Kuchta

[11] Patent Number: 5,412,836

[45] Date of Patent: May 9, 1995

[54] CLOTH CUTTER BED SLAT CLEANER WITH VACUUM REMOVAL FEATURE

[75] Inventor: Richard Kuchta, Tolland, Conn.

[73] Assignee: Gerber Garment Technology, Inc., Tolland, Conn.

[21] Appl. No.: 132,388

[22] Filed: Oct. 6, 1993

[51] Int. Cl.[6] ..... B08B 5/04

[52] U.S. Cl. ..... 15/308; 15/309.1; 15/309.2; 15/312.1

[58] Field of Search ..... 15/308, 309.1, 309.2, 15/306.1, 312.1

[56] References Cited

U.S. PATENT DOCUMENTS 3,737,940 6/1973 Moestue ..... 15/312.1 X
4,951,345 8/1990 Nappi ..... 15/308 X
5,027,462 7/1991 Künzig et al. ..... 15/309.1 X
5,197,160 3/1993 Smith ..... 15/345 X

*Primary Examiner*—Christopher K. Moore
*Attorney, Agent, or Firm*—McCormick, Paulding & Huber

[57] ABSTRACT

A device for cleaning a bristle bed of a conveyor type trained between the rotatable end units employs a carriage which is moveable relative to the conveyor member transversely of its advancement direction and includes a cleaner head which is engagable with individual slats indexed to a cleaning location in line with the head to accomplish cleaning by moving the head laterally of each slat to effect removal of debris contained within the bed.

12 Claims, 7 Drawing Sheets

CLOTH CUTTER BED SLAT CLEANER WITH VACUUM REMOVAL FEATURE

CROSS REFERENCE TO RELATED APPLICATION

This application relates to co-pending U.S. Application Ser. No. 07/943,880 entitled BRISTLE BED CLEANER FOR SHEET MATERIAL CUTTING MACHINE filed in the name of H. Joseph Gerber on Sep. 11, 1992, and which application being commonly assigned with the assignee of the present invention.

BACKGROUND OF THE INVENTION

This invention relates to an apparatus for cleaning the bristle bed of a sheet material cutting machine to remove loose fibers, threads, small pieces of work material and other debris which tend to collect in the spaces between the bristles of the bed during use of the cutting machine, which debris if left unremoved may hinder the efficient operation of the cutting tool and/or may impede air flow through the bed in the event the machine is the type in which a vacuum is applied to the bed during a cutting operation, and deals more particularly with such a cleaner capable of removing the debris from within the bristle bed using a comb and a vacuum combination to effect cleaning.

The work supporting bed used in sheet material cutting machine such as disclosed in U.S. Pat. No. 5,119,704, employs a means providing an upwardly facing flat supporting surface located in a horizontal plane for supporting sheet material to be cut. This means is an endless conveyor member trained over rotatable end units located at opposite ends of the frame of the machine so as to define an upper run of the belt defining the support surface and a belt lower run which defines the return run of the conveyor. The conveyor member in these machines may take many different forms, but is usually comprised of a number of slats extending transversely of the direction of conveyor movement and are linked to one another about hinge axes so as to form a continuous chain. Each slat carries a number of bristle blocks which when positioned in the upper run of the conveyor member have upwardly extending bristles terminating in a common plane to form the supporting surface. The bristles form a bed which is penetrable by a cutting knife, and in which bed may also be contained a vacuum pressure communicated to the supporting surface to aid in the holding and compressing of the material laid upon the support surface to be cut. The bristle units or squares are made of injection molded plastic with each unit having a lower base and a plurality of densely spaced bristles extending normally from the base. Depending on the material or machine application to be used, the bristles can take on varying heights depending on the type of application designated for the cutter. For a more complete description of the slat and the bristle bed assembly features, reference may be had to co-pending U.S. Application Ser. No. 08/124,803 entitled JOINTED BARRIER STRIP and filed on Sep. 21, 1993.

In the use of cutting machines having bristle beds of the aforementioned type, cutting debris tends to collect between the bristles of the bed and should be periodically removed to maintain efficient running of the machine. Debris which collects between bristles is the result of the cutting action of the reciprocating knife as its tip and part of its length is plunged below the support surface and within the densely spaced bristles extending normally from the base of each bristle block. Bristle bed cleaners have been used before, and one such type of cleaner is disclosed in U.S. Pat. No. 4,224,711. Here, an apparatus for cleaning a bristle structure to remove foreign material lodged in the bristles thereof is disclosed as comprising a means for cleaning a bristle structure by alternately accelerating the bristle structure to an elevated speed in one and an opposite direction generally parallel to the bristle extent. The problems associated with this type of cleaner is that cleaning must be achieved by separating the bristle block from the cutting machine, cleaning the block using the apparatus and thereafter reassembling the block to the machine after cleaning. This process is highly labor intensive and does not promote efficient use of time or labor.

The general object of the invention therefore is to provide a bristle bed cleaner to be used on a support surface comprised of a conveyor member wherein individual slats making up the conveyor member are capable of being cleaned so that the debris of fibers, cut cloth pieces and other foreign material lodged within the densely spaced bristles can be removed from within the bed without disassembling the bristle blocks from the holding slats, cleaning and thereafter reassembling the blocks with the involved holding slat.

It is yet a further object of the invention to provide a bristle bed cleaner assembly of the aforementioned type wherein the cleaner assembly is maintained at a predefined station at which individual slats of the conveyor member are indexed to thereby eliminate the need to move the cleaner assembly about the support surface except along a precribed cleaning path.

Still a further object of the invention is to provide a cleaner of the type having a comb-like implement and vacuum which is capable of using both mechanical and air pressure forces to clean foreign matter and other debris from within the bristle bed.

SUMMARY OF THE INVENTION

The invention resides in a means for cleaning the bristle bed of a cutting machine of the type wherein a bristle bed formed from an endless conveyor member trained over rotatable end units located at opposite ends of a frame is used and has a given width taken tranversely to the advancement direction of the conveyor and has a given length taken parallel to the advancement direction of the conveyor. The bristle bed cleaning apparatus is itself comprised of a carriage supported on the frame adjacent the conveyor for movement in a direction extending generally parallel to the given width dimension of the conveyor between one location and another location. The carriage is moved relative to the frame by a positioning means which is secured to the frame to define a cleaning station on the frame taken relative to the conveyor member. The positioning means is drivingly connected to the carriage for controllably driving the carriage between the one and other locations along with the cleaning means so as to engage the bristle bed of the conveyor and clean a discrete area of the bristle bed These discrete areas are defined generally by the portion of the length of the conveyor being indexed to the cleaning station and the distance between the one and the other locations between which the carriage travels. The carriage also carries an actuating means connected to the cleaning means for moving the cleaning means into and out of engagement with the involved one portion of the length of the conveyor.

FIG. *2a* is a partially fragmentary side elevation view of the cleaning station and the front end of the conveyor member.

FIG. *2b* is a partially fragmentary side elevation view showing the cleaning station of FIG. *2a* in cut-away view to reveal the slat locating sensor.

Figure 3:
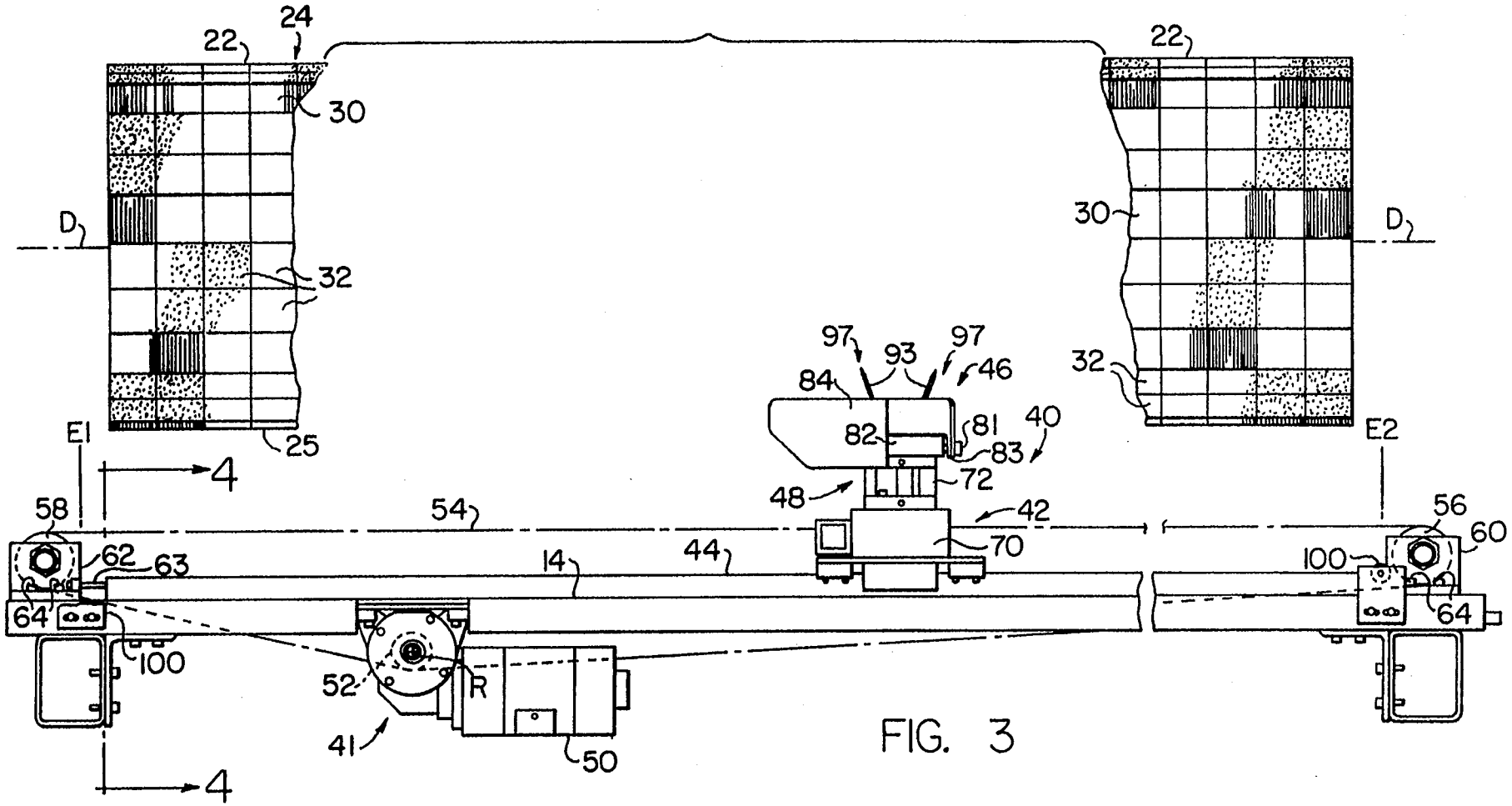
Figure 5A:
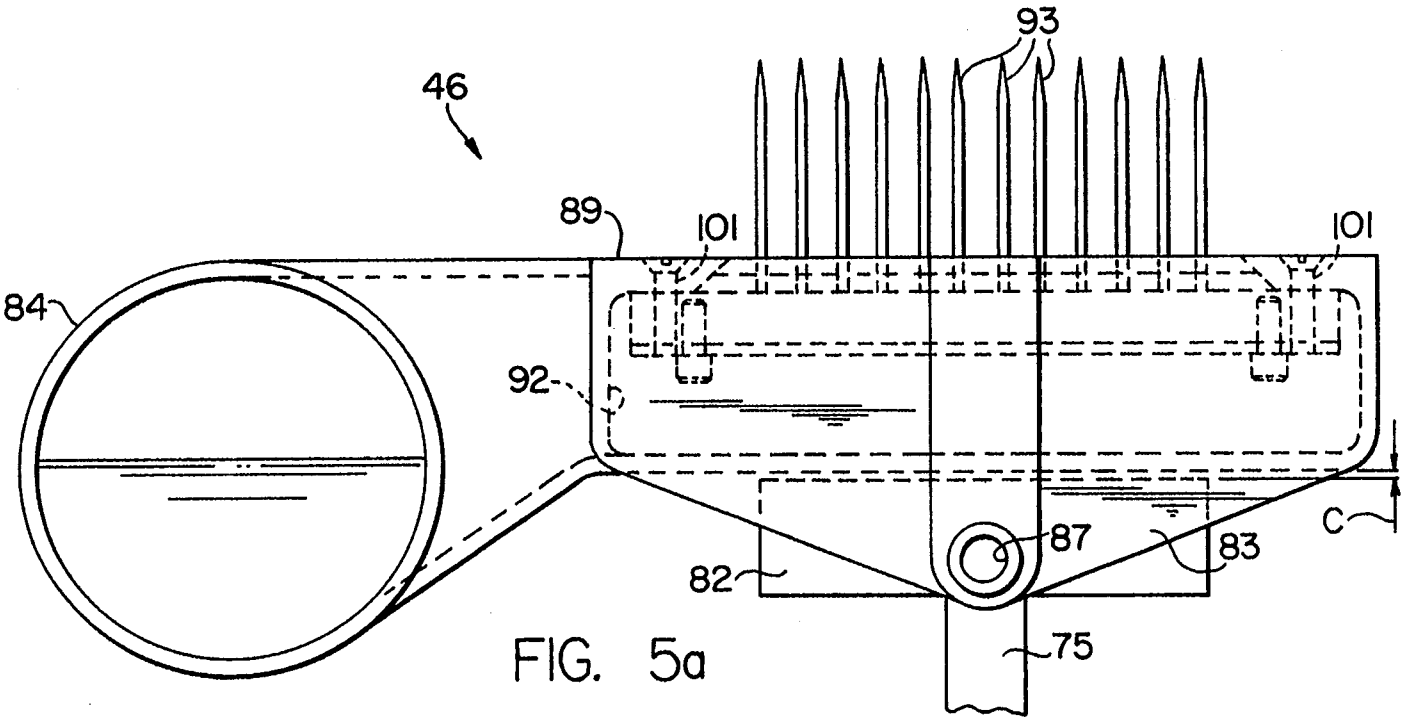
Figure 5B:
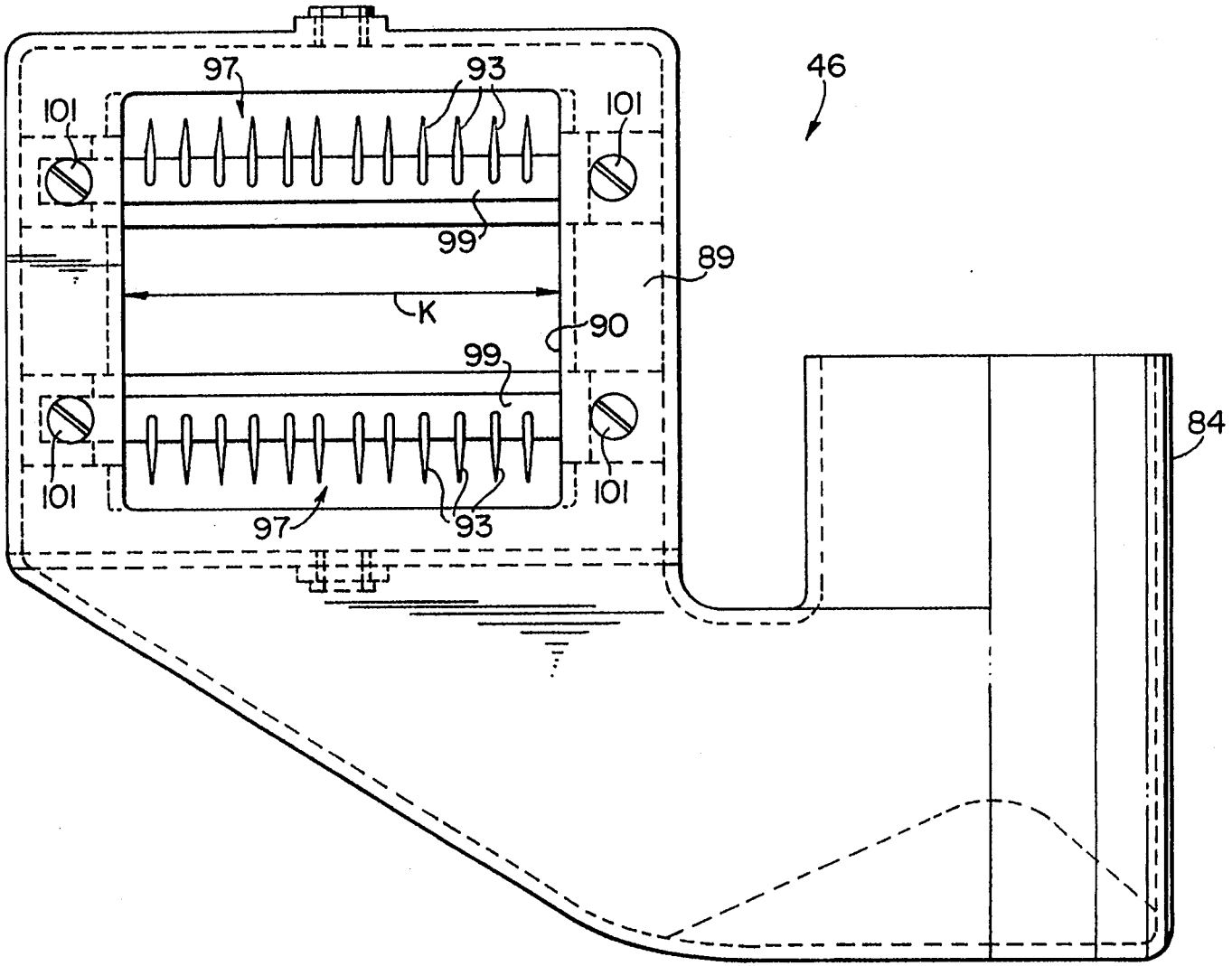
Figure 5C:
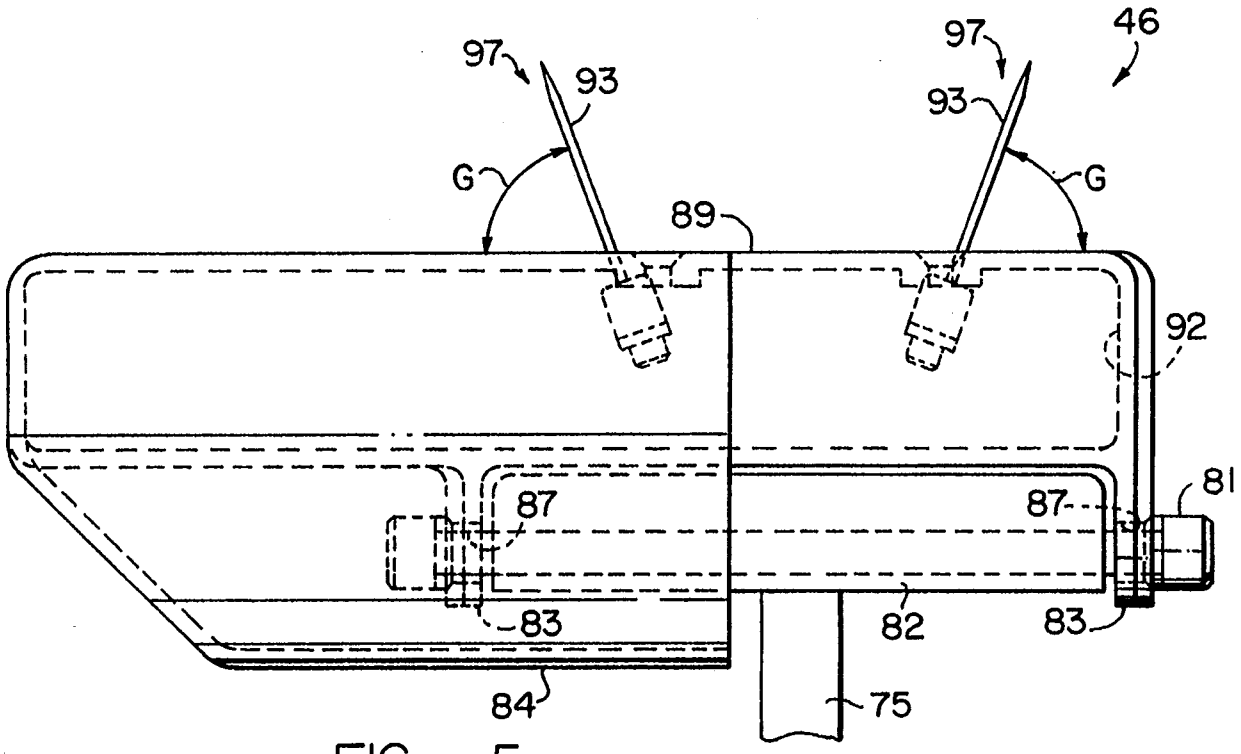

FIG. 3 is a front elevation view of the cleaning station shown apart from the conveyor bristle bed to which it is attached.

Figure 4:
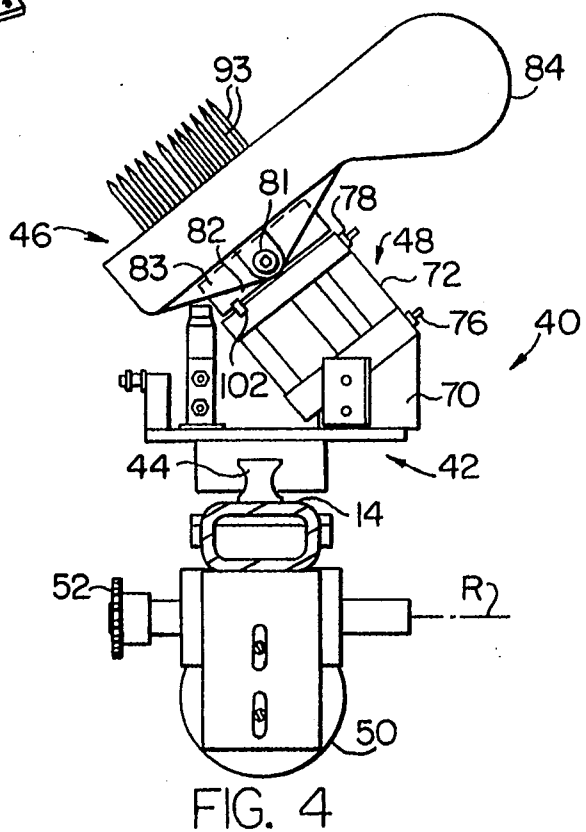

FIG. 4 is a side elevation view showing the cleaner carriage as seen taken along line 4—4 in FIG. 3.

FIG. *5a* is a side elevation view showing the cleaner head and shoulder block assembly.

FIG. *5b* is a top plan view of the cleaner head of FIG. *5a*.

FIG. *5c* is a rear elevation view of the cleaner head shown in FIG. *5b*.

DETAILED DESCRIPTION OF THE PREFERRED EMBODIMENT

Figure 1:
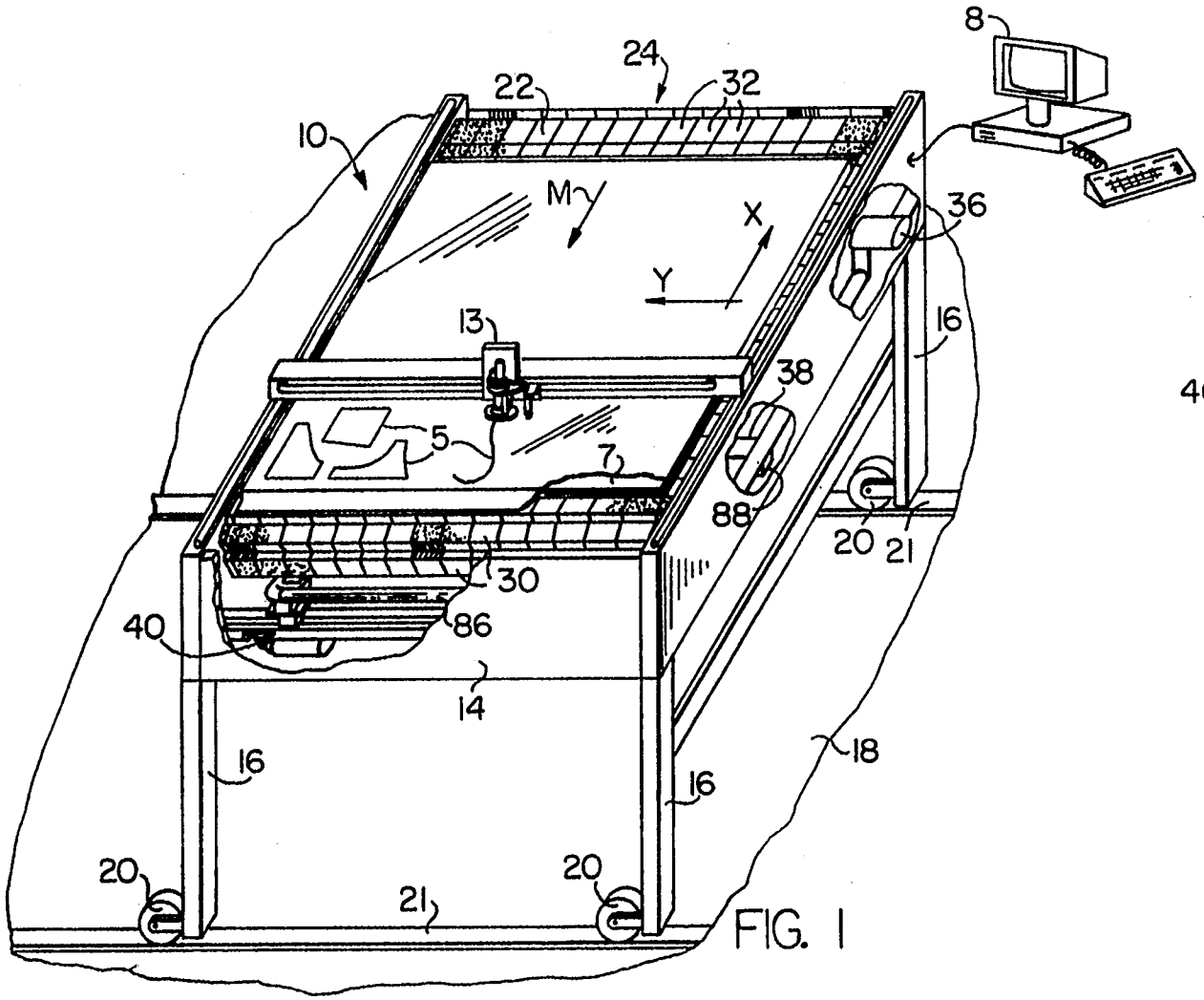
FIG. 1 is a partially fragmentary prespective view showing the cutting machine embodying the present invention.
Figure 2A:
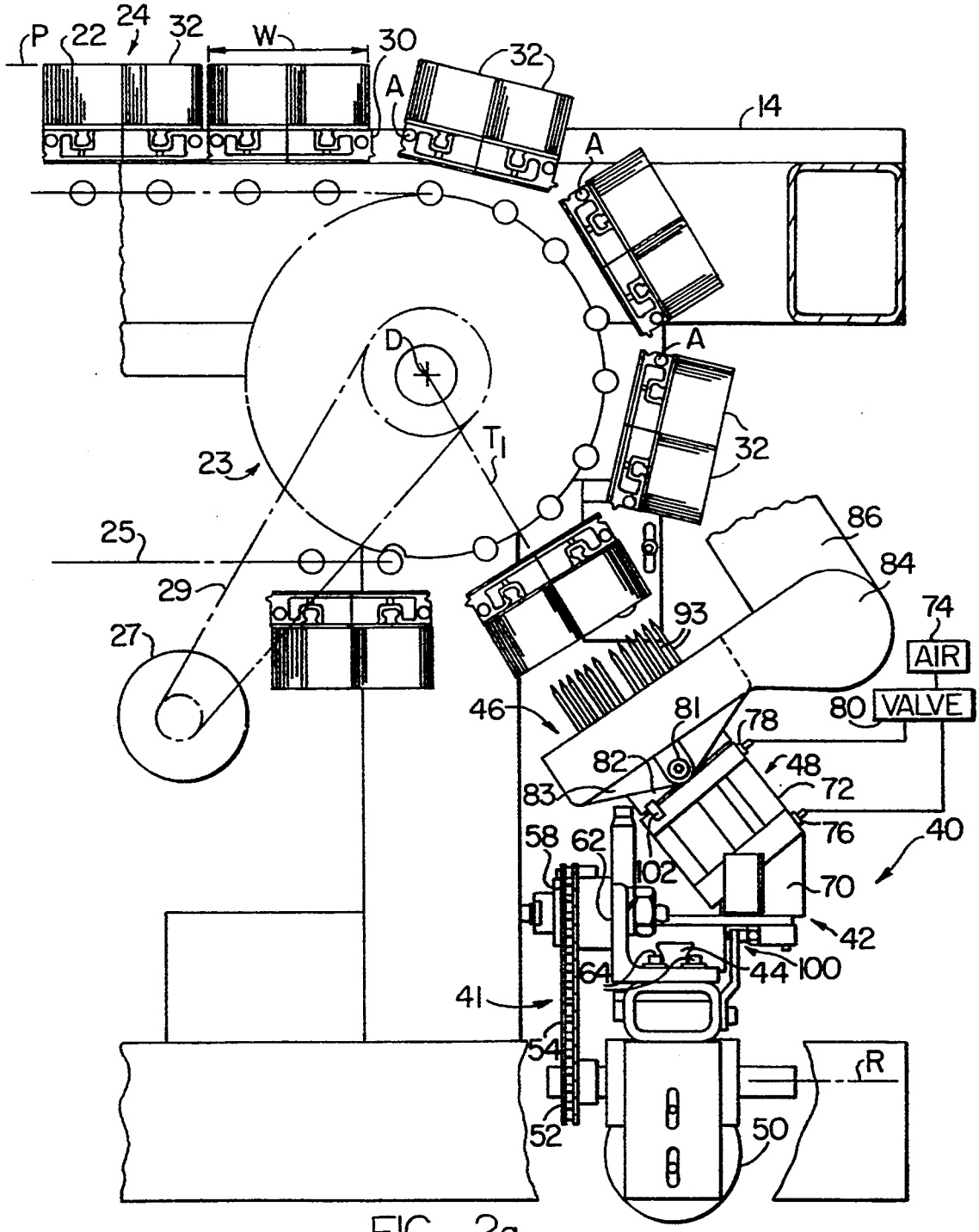
Figure 2B:
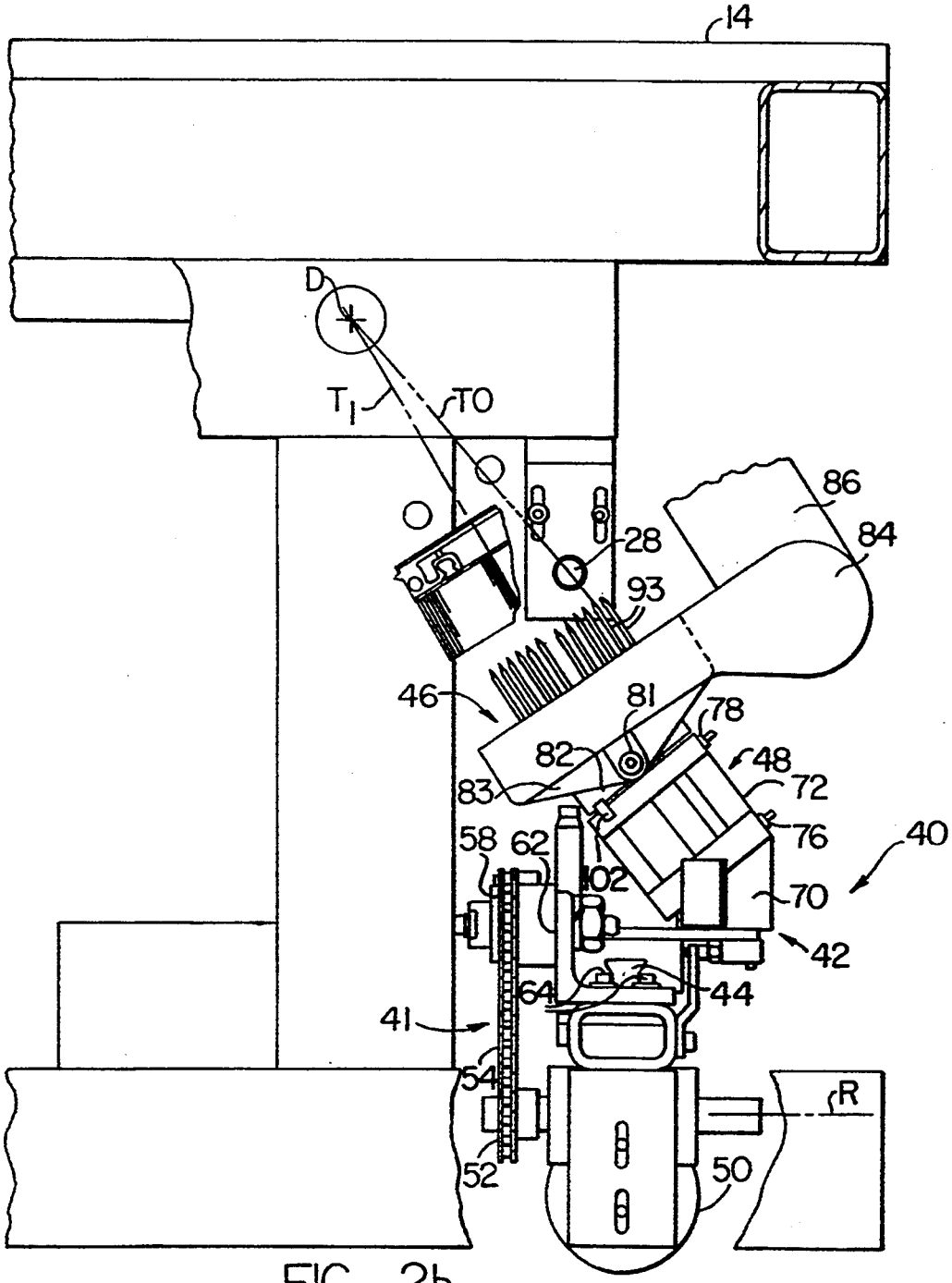

Turning now to the drawings and first referring in particular to FIG. 1, an apparatus embodying the invention is therein shown consisting of a cutting machine indicated generally as 10. The cutting machine includes a coordinate controlled cutter head assembly 13 movable in the indicated X and Y coordinate directions by positioning drive motors (not shown) driven in coordination by a controller 8. The controller 8 maintains position commands in memory which are used to create cut lines 5,5 in a sheet or sheets of material 7 supported on the machine for this purpose. The machine may or may not be combined with a take off table provided for the purpose of moving sheet material off the cutting machine for subsequent handling.

The cutting machine 10 is preferably one such as shown in U.S. Pat. No. 5,189,936 issued to Gerber et al on Mar. 2, 1993, which patent being hereby incorporated by reference. The cutting machine is supported above a floor 18 on a number of legs 16,16 and a frame 14 which may carry a number of wheels 20,20 mounted to the frame so as to mesh with a guide track 21 attached to the floor to ensure proper orientation of the machine when it docks with a spreading table.

The frame of the cutting machine 10 carries a means providing an upwardly facing flat support surface 22 located in a horizontal plane P for supporting sheet material to be cut. The means providing the support surface 22 includes an endless conveyor 24 trained over rotatable end units 23,23 located at opposite ends of the frame 14, one of which end units is shown schematically in FIG. *2a*. The endless conveyor member is supported by the end units rotatable on the frame about axes D,D to define an upper run constituting the support surface 22 of the machine and a lower return run 25 which is contained within the cutting machine. The end units include suitable sprockets positively engaging the conveyor member so that the end units and the conveyor are constrained to move in unison with one another. As shown in FIG. *2a*, the illustrated end unit 23 is driven by a drive motor 27 drivingly connected with the illustrated end unit by a positive drive power transmitting means, such as, a toothed belt or chain 29 cooperating with suitable sprockets affixed to the drive shaft of the motor and to the end unit 23.

The conveyor member 24 moves in the direction indicated by the arrow M parallel to illustrated X-coordinate direction upon normal forward operation of the drive motor 27. The conveyor member is comprised of a number of slats 30,30 of width W and of a length extending in the Y-coordinate direction transversely of the frame 14 and linked to one another about hinge axes A,A extending transversely to the frame to form the continuous chain. Each slat 30,30 carries a number of bristle blocks 32,32 which when positioned in the upper run of the conveyor member, have upwardly extending bristles terminating in the common plane P to form the support surface 22. The bristles therefore form a bed which is penetrable by a cutting knife and which may also be used to contain vacuum pressure communicating to the support surface to aid in holding and compressing the material to be cut. The vacuum provided to the bed is taken from a vacuum source 36 housed within the cutter and communicating with the vacuum bed through a manifold system 38 communicating with the slats 30,30 traveling through the upper run of the conveyor member. For a more complete description of the manifold system as it applies to the communication of vacuum to the slats in a conveyor member, reference may be had to U.S. Pat. No. 5,189,936 issued to Gerber et al on Mar. 2, 1993, which patent being hereby incorporated by reference.

In accordance with the invention, a bristle bed cleaning assembly indicated generally at 40 in FIG. 1 is provided in association with the leading one of the rotatable end units 23,23 and is comprised of a carriage 42, a way 44 disposed on and secured to the frame 14 extending in the indicated Y-coordinate direction slightly further at each of its ends than the length of the slats 30,30, a drive means 41 supported by and secured to the frame 14 and drivingly connected to the carriage 42 for moving the carriage along the way 44 between one and another end positions E1 and E2. The carriage 42 further includes a cleaning head 46 carried by the carriage and a vertical actuator means 48 also supported on the carriage 42 for moving the cleaning head 46 into and out of engagement with the bristles carried by the juxtaposed one of the slats 30,30 located adjacent the cleaning head 46. The carriage and way elements 42 and 44 in the preferred embodiment are commercially available products sold by, for example, The THOMPSON Co. under the tradename "ACCUGLIDE LINEAR BALL BEARING SYSTEM".

As illustrated in FIG. *2b*, the bristle bed cleaning assembly 40 also includes a slat identifying sensor 28 mounted to the frame 14 at a location somewhere between the upper and lower runs of the conveyor member 24. The sensor 28 is angularly disposed relative to the central axis D of the end unit 23 along a radius TO which is disposed angularly counterclockwise more advanced than the indicated reference radius $T_1$ coinciding with the indexing position assumed by one of the plurality of slats indexed to the $T_1$ position during a cleaning operation. Locating the cleaning assembly 40 relative to the end unit 23 in this manner takes advantage of the separation which occurs between slats as the involved length of the conveyor member is caused to make the turn about the unit thereby isolating the indexed slat from those which surround it.

The drive means 41 as best seen in FIGS. *2a, 2b* and 3, includes a bi-directional drive motor 50 having an output shaft connected to a drive sprocket 52 mounted for rotation to the frame 14 below the way 44 and about a rotational axis R extending parallel with the indicated X-coordinate axis. The drive sprocket 52 is drivingly connected with the carriage 42 through the intermediary of a drive chain 54 fixedly connected to the carriage 42 and trained about a first idler pulley 56 disposed at one end of the way 44 and a second idler pulley 58 disposed at the other opposite end of the way to effect positioning of the carriage along a path of travel betweem the indicated E1 and E2 positions. As illustrated in FIG. 3, the travel path defined by these points is slightly longer than the length of each of the slats 30,30 taken in the indicated Y coordinate direction. Each of the idler pulleys 56 and 58 is mounted to the frame through an L-shaped flange 60 and 62, respectively, secured to the frame through the intermediary of securement bolts 64,64 received in openings formed in the horizontally disposed portions of the flanges. In at least one of the horizontally disposed portions of the flanges, which in the illustrated case is flange 62, the openings which receive the securement bolts are slot-like in form, with the elongate dimension of each slot being disposed in the indicated Y-coordinate direction to thereby allow adjustments to be made to the spacing between each of the flanges 60 and 62. Further to these ends, the idler pulley 58 associated with the end of travel position E1 includes a tensioning bolt 63 which acts against the way 44 to cause the chain 54 to be tightened to an appropriate tension. Such tensioning is important because the chain, as shown in FIG. 3, follows a path about each of the idler pulleys 56 and 58 and is then downwardly turned toward the drive sprocket 52 to allow the chain to engage with a section of the sprocket so that upon appropriate tensioning of the chain by the tensioning bolt 63, the chain is drawn into close engagement with the sprocket and is maintained in a driving relation with it during the positioning process.

The way 44 is located on the frame 14 so as to position the cleaner head 46 below the return run of the conveyor member 24 and adjacent the end unit 23 so that the cleaner head is always positioned in line with the $T_1$ radius of that unit. For this purpose, an angled block 70 is secured to the carriage 42 and supports the actuator means 48, and hence the cleaner head 46, relative to the floor 18 at an angle of approximately 60 degrees. The cleaner head 46 is vertically movably positionable into and out of engagement with the bristles of the slat indexed to the $T_1$ position. The assembly includes for this purpose a double acting actuator 72 secured to the block 70 and having an extendable and retractable piston rod 75 moved between these positions by applied pressurized air supplied at a source 74 communicating through .appropriate air lines to inlets 76 and 78, respectively, controlling the extension and retraction of the cleaner head through the controlled actuation of a flow redirecting valve 80 interposed between the air source 74 and the actuator 72.

Referring now to FIGS. *5a, 5b* and *5c*, it should be seen that the actuator means and the cleaning head are connected to one another through the intermediary of the movable piston rod 75 and a shoulder block 82 which is fixed to the distal end of the piston rod. The cleaner head 46 includes two depending flanges 83,83 which are spaced apart from each other sufficiently to receive the shoulder block therebetween, but which flanges are nevertheless closely enough spaced so as to minimize lateral shifting movement of the shoulder block relative to the flanges when assembled. Aligned openings 87,87 are formed in each of the depending flanges 83,83 and receive in a journalling relationship therein a bolt 81 pivotally connecting the cleaner head to the block 82 such that a slight clearance C is provided between the opposed faces of the cleaning head and the shoulder block. This clearance provides the cleaner head 46 with a slight tilting capability which allows it to flushly engage with the bristle surface of the indexed slat if that slat is not positioned exactly in line with the $T_1$ positioning line when the actuator 72 causes the cleaner head 46 to be moved to its extended position from the retracted position shown in the illustrated embodiment of FIGS. *2a* and *2b*.

The cleaning head 46 is an internally hollow metallic member having an upper surface 89 facing the conveyor member 24 and defining an internal chamber 92 communicating with an opening 90 formed therein for drawing debris away from the bristles. The internal chamber further communicates with a vacuum source coupling duct 84 connected to the vacuum source 36 through a flexible tubular member or line 86 as illustrated in FIG. 1 so as to introduce vacuum to the head as the cleaner head moves between the E1 and E2 positions. During a bristle bed cleaning operation, vacuum is diverted from the manifold 38 and is consequently redirected to the line 86 through a flow redirecting valve 88 which redirects the entire vacuum flow otherwise diverted to the bristle bed to the cleaner head 46. The vacuum head opening 90 may take many different shapes, but in the preferred embodiment it is a square having 3 inch by 3 inch dimensions offering an effective cleaning width K sufficient to cover a substantial portion of the slat width W; while the inner diameter of the vacuum line 86 may range between 2.5 to 3.0 inches.

Disposed across the opening 90 are a plurality of pin like members 93,93 arranged in rows 97,97 each extending generally parallel to the indicated X-coordinate direction or extending generally perpendicularly to the longitudinal extent of the slats. The pins 93,93 of each row 97,97 are fixedly mounted on securement bars 99 which are secured within the cleaner head by fasteners, such as screws 101,101 or the like, so as to be recessed away from the upper surface 89 of the cleaner head.

The free ends of the pins 93,93 are dimensioned so as to have tapered end portions which when inserted into the bristle bed are capable of deflecting the otherwise normally disposed individual bristle members laterally away from the direction of travel taken by the cleaner head during a cleaning operation. The actuator 72 moves the cleaner head into confrontion with the bristle surface of the indexed slat only so much as to cause partial penetration of the pins. For example, the bristles in the illustrated example of FIGS. *2a* and *2b* are one inch in length and when the piston rod 75 is moved to its extended position, the pins, which in the illustrated example are about $\frac{3}{4}$ of an inch long, only have a penetration depth of about $\frac{5}{8}$ of an inch into the bristle bed.

Each row of the pins 93,93 makes an angle G with the upper surface 89 of the cleaner head, equal to approximately 60 degrees, so as to allow the trailing row of pins to collect the debris as the head is moved along a slat indexed to the $T_1$ position so that cleaning can be done at the discretion of the operator, in a single pass to effect a combing action through the bristles as the head is moved between the E1 and E2 positions.

In operation, the cleaning of the bristle bed is accomplished in a down condition of the cutting machine, that is without sheet material being supported or cut on the support surface 22. The process is initiated by the controller 8 first energizing the vacuum flow redirecting valve 88 such that vacuum generated by the vacuum generator 36 is communicated to the cleaner head 46. Next, the conveyor drive motor 27 is energized so as to advance the slats in the indicated M advancement direction while at the same time the controller 8 interrogates the slat positioning sensor 28 to the point where it first detects the leading edge of the slat moving to the $T_1$ position. Upon first detecting the presence of the slat, the controller stops the drive motor 27 such that the detected slat is now located substantially at the $T_1$ index position. Once stopped, the controller energizes the valve 80 to move the head from an otherwise retracted position to an extended position. Upon energization of the actuator 72 in this fashion to cause the pins 93,93 to engage within the bristles of the indexed slat, the cleaner head position drive motor 50 is then energized in one direction to move the support carriage 42 and hence the cleaner head 46 from one end of the way 44 to the other between the E1 and E2 end positions. Reverse energization of the motor 50 may be effected when the carriage reaches the end of travel position for a given pass where more than one pass is to be made over the indexed slat. In this way, discrete areas of the conveyor bristle bed 22 are cleaned, which discrete areas are defined by the active cleaning width dimension K of the cleaner head and the distance travelled by the head along the length of the indexed slat.

End of travel sensors 100,100 are also provided on the frame 14 and are connected to the controller for sensing the presence of the carriage 42 at locations along the way corresponding generally to the E1 and E2 end of travel positions to thus indicate the presence of the carriage 42 just prior to arriving at these end of travel positions. Once the controller 8, through an appropriate interrogation of the sensors 100,100 determines the carriage to be at its end of travel position, it subsequently causes the positioning drive motor 50 to stop and the valve 80 to reverse energize the actuator 72 thereby returning the head to its retracted position out of engagement with the involved bristle slat. An up-down sensor 102 is located on the carriage 42 and is provided for the purpose of sensing the presence of the cleaner head in the retracted position. This sensor is interrogated to establish that a down condition exists before futher indexing of the next slat can be effected. This prevents inadvertent advancement of the conveyor member while the pin members 93,93 of the cleaner head are still engaged within the bristle bed of the indexed slat. The process continues in this way until all slats in the bed have been cleaned by the vacuum head.

By the foregoing, a bristle bed cleaner of the aforementioned type has been disclosed in the preferred embodiment. Numerous modifications and substitutions may be had to the invention without departing from the spirit of the invention. For example, the head cleaner may make one or more passes across an indexed slat in order to effect a cleaning based on the make-up of the bristle blocks used or the amount of debris contained in the bed.

Accordingly the invention has been described by way of illustration rather than limitation.

I claim:

1. In a cutting machine of the type having a bristle bed formed from an endless conveyor member trained over rotatable end units located at opposite ends of a frame and having a given width taken tranversely to the advancement direction of the conveyor and a given length taken along the advancement direction of the conveyor, a bristle bed cleaning apparatus comprising:

a carriage supported on said frame adjacent the conveyor for movement in a direction extending generally parallel to the given width dimension of the conveyor between one location and another location;

positioning means secured to the frame to define a cleaning station on the frame relative to the conveyor member and being drivingly connected to the carriage for controllably driving the carriage between said one and said another locations;

cleaning means mounted to said carriage for movement therewith between said one and the another locations for engaging with the bristle bed of the conveyor so as to clean a discrete area of the bristle bed as defined generally by a discrete portion of the length of the conveyor member and the distance travelled by the carriage between said one and the other locations; and means carried by the carriage and connected with the cleaning means for moving the cleaning means into and out of engagement with one portion of the length of the conveyor at a time.

2. The combination as set forth in claim 1 further characterized by said positioning means includes a way fixed to said frame and said way being disposed in a direction substantially orthogonal to the advancement direction of said conveyor member, said carriage being movable along said way, said conveyor member having means for indexing discrete portions of its length to a cleaning position corresponding to a position adjacent said cleaning means, and said cleaning means includes a cleaner head engagable with the surface of the bristle bed.

3. The combination as set forth in claim 2 further characterized in that said way is disposed below the conveyor member and said means carried by the carriage for moving the cleaning means into and out of engagement with the conveyor member further includes a vertical actuator means for moving the cleaner head into and out of engagement with the involved discrete portion of the length of the conveyor member to be cleaned.

4. The combination as set forth in claim 3 further characterized in that said cleaner head includes a plurality of pins arranged in at least one row extending generally orthogonally to the width dimension of the conveyor member.

5. The combination as set forth in claim 4 further characterized in that said conveyor member is comprised of a plurality of slats extending in the direction of the width of the conveyor member and linked to one another about hinge axes to form a continuous chain;

each slat carrying a number of bristle blocks which when positioned in the upper run of the conveyor member have upwardly extending bristles terminating in a common plane to form the supporting surface of the cutting machine; and wherein said cleaning apparatus is located adjacent and below one of said rotatable end units so that individual ones of said slats can be indexed to a given angular orientation and subsequently separately engaged by the cleaning head.

6. The combination as set forth in claim 5 further characterized by said conveyor member includes drive means including a positioning drive motor connected to the frame and connected to the carriage through the intermediary of a chain loop;

said chain loop being secured against movement to the carriage and being trained at opposite ends of said way on idler pulleys which cause the carriage to be moved between the one and the other positions in response to the position drive motor being energized or deengerized.

7. The combination as defined in claim 6 further characterized in that said cleaning head is vertically moveably connected to the vertical actuator means by a shoulder block pivot connection which seats the cleaning head flushly with respect to the slat indexed to the cleaning position.

8. The combination as set forth in claim 7 further characterized in that said cleaner head is defined by an upwardly disposed surface having an opening formed therein and communicating with an internal chamber formed in the cleaner head; and said cleaner head further including a vacuum source duct communicating with the internal chamber and with a vacuum source through the intermediary of a flexible tube.

9. The combination as defined in claim 8 further characterized in that the free ends of the pin members are tapered and extend only partially into the support surface when the cleaner head engages with the bristles of the indexed slat.

10. The combination as defined in claim 9 further characterized in that said frame includes a slat identifying sensor and said control means includes a means for interrogating said slat identifying sensor for determining the position of the slat to be indexed and for determining the up/down condition of said head relative to said carriage.

11. An apparatus as defined in claim 10 further characterized in that said cleaning means is positioned below said conveyor member adjacent the leading rotating end unit so as to be positioned in line radially with a given slat when indexed to the cleaning position; and wherein said cleaning head is oriented at an angle on said carriage relative to said support surface so as to be positioned radially in line with the indexed slat to be cleaned taken relative to the center of the rotating end unit.

12. A cutting machine comprising:

a frame;

a bristle bed formed from an endless conveyor member trained over rotatable end units located at opposite ends of the frame and having a given width taken transversely to the advancement direction of the conveyor member and a given length taken along the advancement direction of the conveyor member;

a carriage supported on said frame adjacent the conveyor for carrying a cleaning means for movement in a direction extending generally parallel to the given with dimension of the conveyor between one location and another location;

positioning means secured to the frame to define a cleaning station on the frame relative to the conveyor member and being drivingly connected to the carriage for controllably driving the carriage between said one and other locations;

said cleaning means mounted to said carriage for movement therewith between said one and the other locations for engaging with the bristle bed of the conveyor so as to clean a discrete area of the bristle bed as defined generally by a portion of the length of the conveyor and the distance traveled by the carriage between said one and the other locations; and means carried by the carriage and connected with the cleaning means for moving the cleaning means into and out of engagement with one portion of the length of the conveyor at a time;

said positioning means including a way fixed to said frame and said way being disposed in a direction substantially orthogonal to the advancement direction of said conveyor member, said carriage being movable along said way, said conveyor member having means for indexing discrete portions of its length to a cleaning position corresponding to a position adjacent said cleaning means.

* * * * *